US008453277B2

(12) United States Patent
Liu et al.

(10) Patent No.: US 8,453,277 B2
(45) Date of Patent: Jun. 4, 2013

(54) BABY CARRIER WITH AN ADJUSTABLE BACK PLATE

(75) Inventors: Tsan-Ming Liu, Tainan (TW); De-Xiang Lei, Yun-Nan Province (CN)

(73) Assignee: Lerado (Zhong Shan) Industrial Co., Ltd., Zhong Shan, Guang Dong Province (CN)

( * ) Notice: Subject to any disclaimer, the term of this patent is extended or adjusted under 35 U.S.C. 154(b) by 139 days.

(21) Appl. No.: 13/051,978

(22) Filed: Mar. 18, 2011

(65) Prior Publication Data

US 2011/0225729 A1 Sep. 22, 2011

(30) Foreign Application Priority Data

Mar. 19, 2010 (CN) ..... 2010 2 0148240 U

(51) Int. Cl.
*A47D 13/02* (2006.01)

(52) U.S. Cl.
USPC ..... 5/93.1; 5/652.1; 5/494; 5/655; 224/160

(58) Field of Classification Search
USPC ..... 5/93.1
See application file for complete search history.

(56) References Cited

U.S. PATENT DOCUMENTS

| | | | | |
|---|---|---|---|---|
| 2009/0077738 | A1* | 3/2009 | Burns et al. | 5/93.1 |
| 2009/0077739 | A1* | 3/2009 | Mendes et al. | 5/93.1 |
| 2009/0077740 | A1* | 3/2009 | Jackson et al. | 5/93.1 |
| 2011/0197358 | A1* | 8/2011 | Bu et al. | 5/93.1 |

FOREIGN PATENT DOCUMENTS

WO WO 9318690 A1 * 9/1993

* cited by examiner

*Primary Examiner* — Robert G Santos
*Assistant Examiner* — Brittany Wilson
(74) *Attorney, Agent, or Firm* — Tim Tingkang Xia, Esq.; Morris Manning & Martin, LLP

(57) ABSTRACT

A baby carrier with an adjustable back plate comprises a main body, a back plate, a belt and a belt adjustment mechanism. The main body has a bottom wall, two long side walls and two short side walls. The back plate is pivoted on the bottom wall for support baby-occupant in a selected inclination. The belt has a distal end affixed to one side of the main body and an adjustable length for passing across underneath the back plate for retaining the back plate in the selected inclination angle. The belt adjustment mechanism is mounted on the opposite side of the main body for adjusting the adjustable length of the belt by pulling the free end thereof and pressing the back plate downwardly just under the instinct of the care-giver.

10 Claims, 6 Drawing Sheets

BABY CARRIER WITH AN ADJUSTABLE BACK PLATE

CROSS-REFERENCE TO RELATED APPLICATIONS

This non-provisional application claims priority under 35 U.S.C. §119(a) on Patent Application No. 201020148240.3 filed in People's Republic of China on Mar. 19, 2010, the entire contents of which are hereby incorporated by reference.

FIELD OF THE INVENTION

The present invention relates generally to a baby carrier with an adjustable back plate, especially to a back plate which is pivoted to a baby carrier and adjustable to the inclination angle by pulling a belt under the instinct of user.

BACKGROUND OF THE INVENTION

Baby carrier is used to transport a baby, and sometime it also can be used as a bassinet. Some traditional baby carrier provides an adjustable back plate for support a baby-occupant with most comfortable inclination angle. However, the caregivers should hold the baby-occupant up before he can adjust such an adjustable back plate, this would awake the baby-occupant from sleep.

To avoid waking up the baby-occupant while adjusting the inclination angle, an improvement is provided in Taiwan Patent No. M263894, which can adjust the inclination angle from outside of the baby carrier. However, the improved baby carrier of Taiwan Patent No. M263894 has very limited positions for adjusting the inclination angle, could not meet all baby-occupant's need. A further improvement disclosed in China Patent Application No. 2008 2 0048634.4 provides baby carrier which can be adjusted to the back plate by turning a knob from one side; however, to turn the knob again and again, the adjustment is very slow and requiring strenuous effort.

SUMMARY OF THE INVENTION

For adjustment to the inclination angle of back plate faster than the related art, the present invention provides a baby carrier with an adjustable back plate comprises a main body, a back plate, a belt and a belt adjustment mechanism. The main body has a bottom wall, two long side walls and two short side walls. The back plate is pivoted on the bottom wall for support baby-occupant in a selected inclination. The belt has a distal end 40 affixed to one side of the main body and an adjustable length for passing across underneath the back plate for retaining the back plate 3 in the selected inclination angle. The belt adjustment mechanism is mounted on the opposite side of the main body for adjusting the adjustable length of the belt by pulling the free end thereof and pressing the back plate downwardly just under the instinct of the care-giver.

BRIEF DESCRIPTION OF THE DRAWINGS

The accompanying drawings, which are included to provide a further understanding of the invention are incorporated in and constitute a part of this specification, illustrate embodiments of the invention and together with the description serve to explain the principles of the invention. In the drawings.

DETAILED DESCRIPTION OF THE PREFERRED EMBODIMENTS

Reference will now be made in detail to the preferred embodiments of the present invention; examples of which are illustrated in the accompanying drawings.

Referring to FIGS. 1 to 7, a prefer embodiment of baby carrier with an adjustable back plate comprises a main body 2, a back plate 3, a belt 4 and a belt adjustment mechanism 5.

Figure 1:
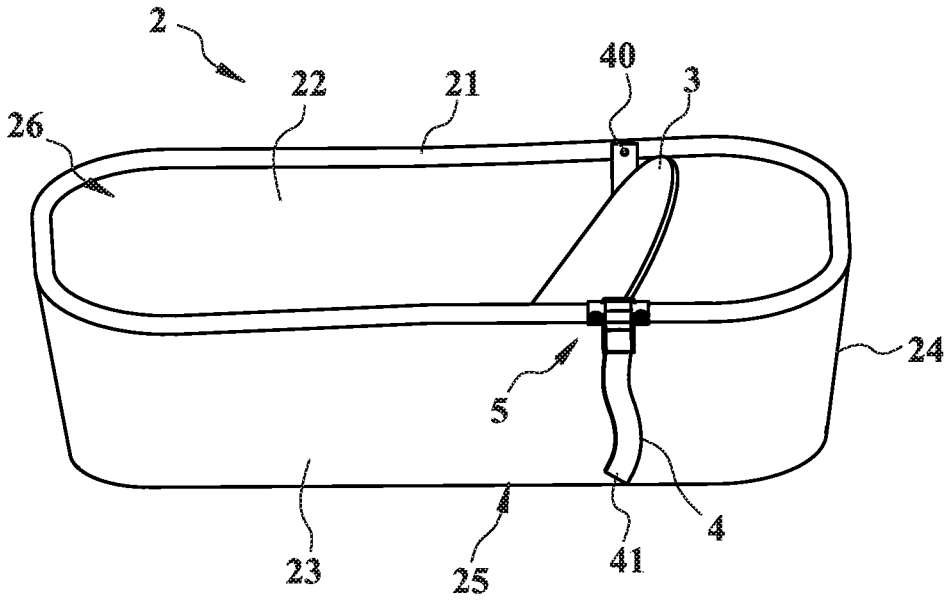
FIG. 1 is a perspective view showing a baby carrier with an adjustable back plate according to the present invention.
Figure 2:
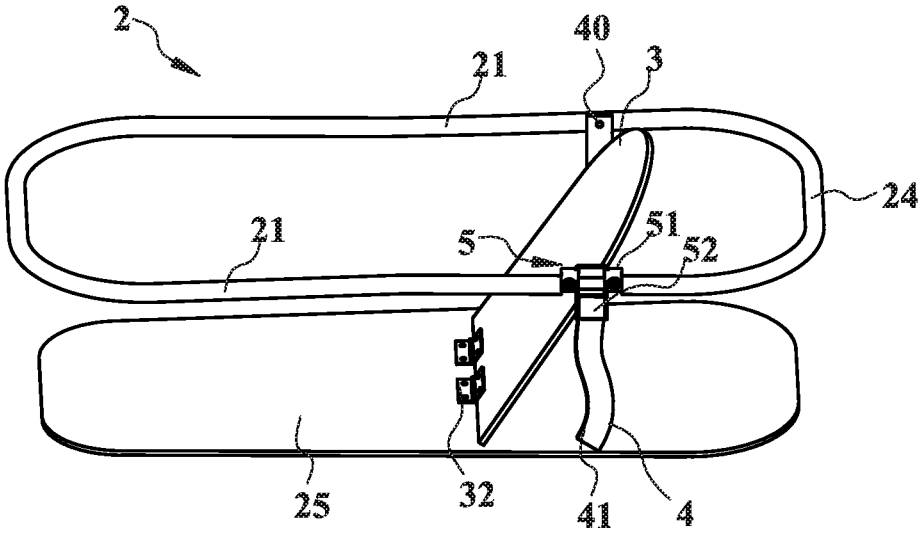
FIG. 2 is a perspective view showing the baby carrier removed the fabric cover for better understanding to the present invention.

Referring to FIGS. 1 and 2, the main body 2 may be constructed with an upper rack 21 and a fabric cover 22 attached or hanged on the upper rack, thereby forming a bottom wall 25, two long side walls 23 and two short side walls 24, and a space 26 for accommodating a baby-occupant sleeping therein.

The back plate 3 has a lower end pivoted to the bottom wall 25 by hinge 32 for supporting a baby-occupant in a selected inclination angle θ.

Figure 4:
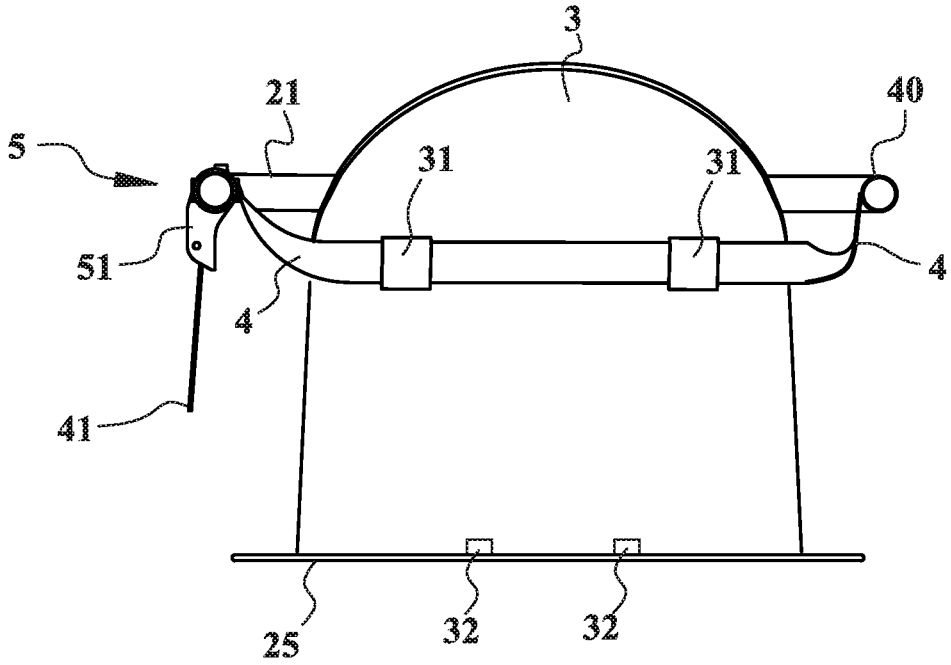
FIG. 4 is a rear view schematically showing the belt holding the back plate for adjusting the inclination angle thereof.
Figure 6:
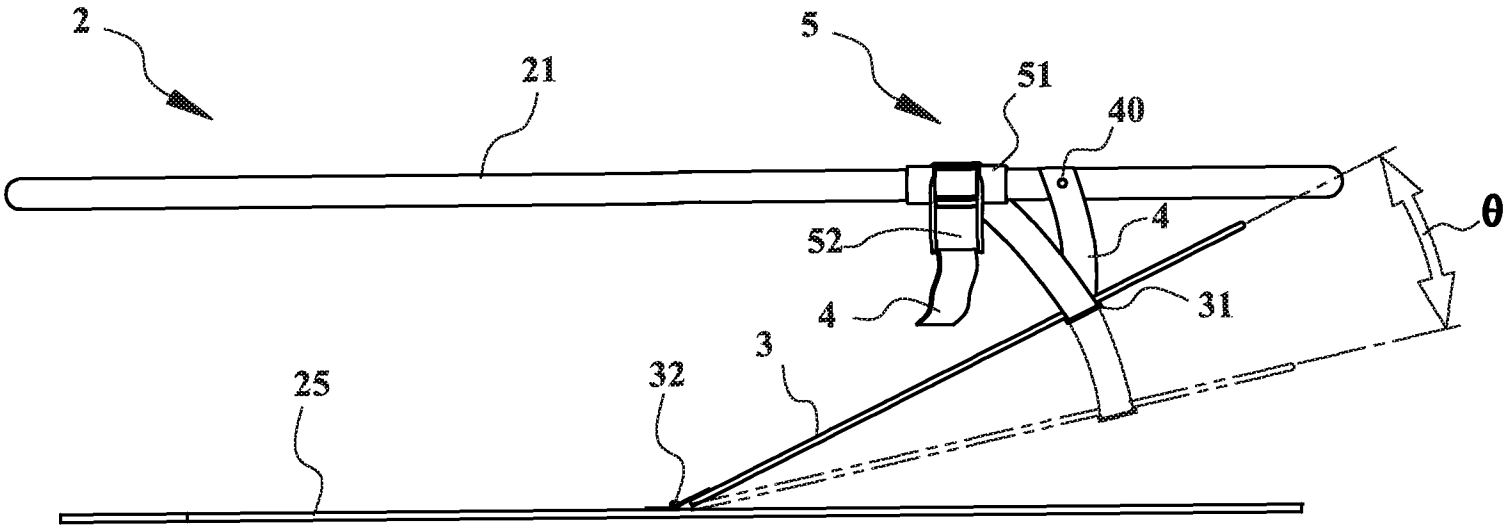
FIG. 6 is a schematic side view showing the adjustment of the back plate.

Referring to FIGS. 1, 4 and 6, the belt 4 has a distal end 40 affixed to one side of the main body 2 and an adjustable length that passing across underneath the back plate 3 for retaining the back plate 3 in a selected inclination angle θ. Preferable, the back plate 3 may further include alt least a loop for holding the belt 4 to pass therethrough. The distal end 40 may either affixed to the upper end of the long side wall 23 or the upper rack 21.

The belt adjustment mechanism 5 is mounted on the opposite side of the main body 2 for adjusting the adjustable length of the belt 4 by pulling the free end 41 thereof and pressing the back plate 3 downwardly under the instinct of the care-giver. Preferably, the belt adjustment mechanism 5 is mounted on either the upper end of the long side wall 23 or the upper rack 21.

Figure 3:
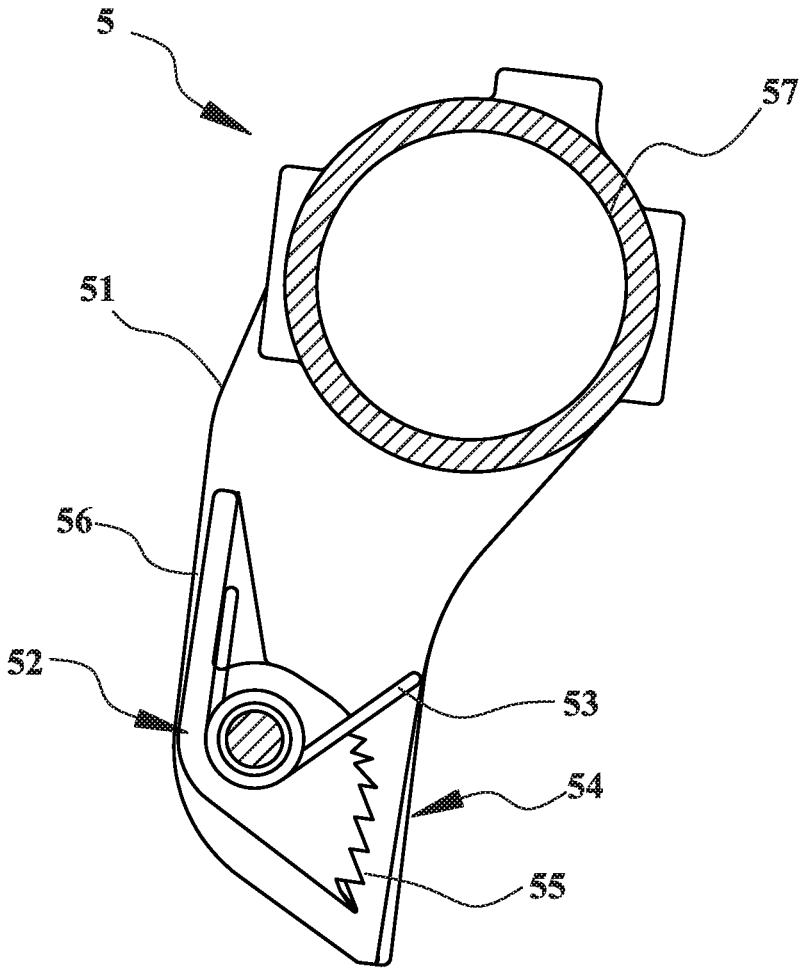
FIG. 3 is a perspective view schematically showing a belt adjustment mechanism of the baby carrier according to the present invention.

As shown in FIG. 3, the belt adjustment mechanism 5 comprises a mount 51, a release actuator 52 and a resilient element 53. The mount 51 is attached to the upper rail 21 with a metal collar 57.

The release actuator 52 is pivoted to the mount 51 and formed a gap therebetween. Preferably, the mount 51 may further include a ragged surface 54 for resisting the belt 4 from sliding inside the gap.

The resilient element 53 may be embodied as a torsion spring for biasing the release actuator 52 so as to releasably clamp the belt 4 for adjusting the adjustable length of the belt 4.

Figure 5:
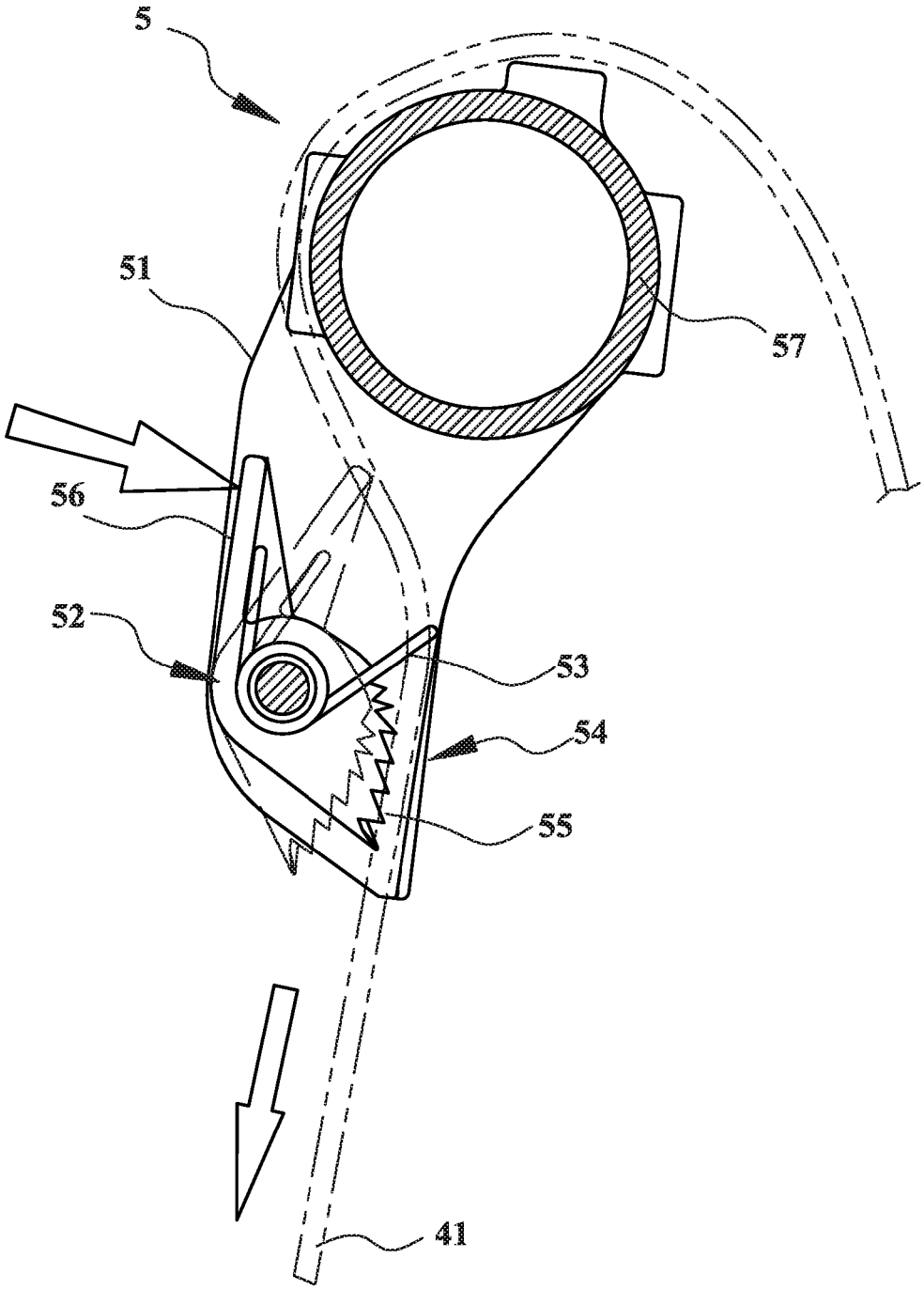
FIG. 5 is a schematic view showing the operation of the belt adjustment mechanism.

As shown in FIG. 5, the free end 41 of the belt 4 being passing through the gap. The resilient element 53 biasing on the release actuator to press against the belt. Preferably, the release actuator 52 may further be formed with a pressing portion 55 with either a ragged surface or teeth-like portion, such as one-way ratchet for pressing and resisting the belt 4 from sliding inside the gap. Further, the release actuator 52 may be formed with a button-like portion 56 for rotating the release actuator 52 against the biasing force from the resilient element 53

Figure 7:
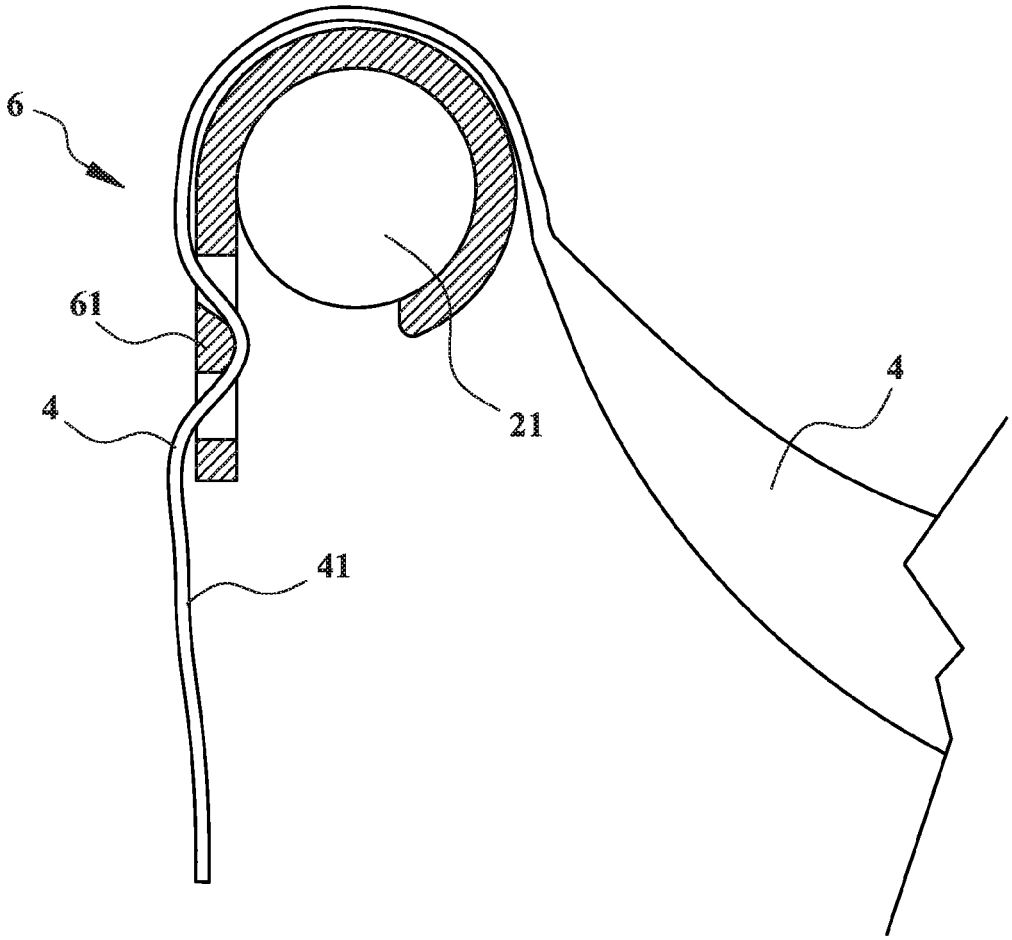
FIG. 7 is a schematic view exampling a belt adjustment mechanism being embodied as a tri-bar adjuster.

Referring to FIG. 7, a simplified belt adjustment mechanism 6 may be alternatively embodied as a known tri-bar adjuster. The care-giver may either pulling the free end 41 of the belt 4 downwardly or pressing the back plate 3 downwardly to adjust the inclination angle θ thereof, it just be controllable under the instinct of the care-giver.

While particular embodiments of the invention have been described, those skilled in the art will recognize that many modifications are possible that will achieve the same goals by substantially the same system, device or method, and where those systems, devices or methods still fall within the true spirit and scope of the invention disclosed.

What is claimed is:

1. A baby carrier with an adjustable back plate, comprising:

a main body, having a bottom wall, a pair of long side walls and a short side walls;

a back plate pivoted on the bottom wall for supporting a baby-occupant at a selected inclination angle;

a belt, having a distal end affixed to one side of the main body, and an adjustable length for passing across underneath the back plate for retaining the back plate at the selected inclination angle; and a belt adjustment mechanism, mounted on the opposite side of the main body for adjusting the adjustable length of the belt by pulling a free end thereof and pressing the back plate downwardly.

2. The baby carrier with an adjustable back plate according to claim 1, wherein the back plate may further include at least a loop for holding the belt to pass therethrough.

3. The baby carrier with an adjustable back plate according to claim 1, wherein the main body includes an upper rack and a fabric cover hanged on the upper rack.

4. The baby carrier with an adjustable back plate according to claim 3, wherein the distal end of the belt is affixes to the upper rack.

5. The baby carrier with an adjustable back plate according to claim 1, wherein the belt adjustment mechanism comprising:

a mount attached to one side of the main body;

a release actuator, pivoted to the mount and formed a gap therebetween, the belt having a free end capable of passing through the gap; and a resilient element biasing on the release actuator to press against the belt.

6. The baby carrier with an adjustable back plate according to claim 5, wherein the mount has a ragged surface for preventing the belt from sliding at the gap.

7. The baby carrier with an adjustable back plate according to claim 5, wherein the release actuator has a pressing portion with a ragged surface for pressing against the belt.

8. The baby carrier with an adjustable back plate according to claim 7, wherein the pressing portion includes a teeth-like portion.

9. The baby carrier with an adjustable back plate according to claim 5, wherein the resilient element is a torsion spring.

10. The baby carrier with an adjustable back plate according to claim 1, wherein the belt adjustment mechanism is a tri-bar adjuster.

* * * * *